US011299878B2

(12) United States Patent
Grooms et al.

(10) Patent No.: US 11,299,878 B2
(45) Date of Patent: Apr. 12, 2022

(54) VACUUM SEWAGE SYSTEM WITH SUMP BREATHER APPARATUS

(71) Applicant: Aqseptence Group, Inc., Rochester, IN (US)

(72) Inventors: John M. Grooms, Rochester, IN (US); Troy E. Blocher, Warsaw, IN (US)

(73) Assignee: Aqseptence Group, Inc., Rochester, IN (US)

( * ) Notice: Subject to any disclaimer, the term of this patent is extended or adjusted under 35 U.S.C. 154(b) by 0 days.

(21) Appl. No.: 16/360,438

(22) Filed: Mar. 21, 2019

(65) Prior Publication Data

US 2020/0299947 A1 Sep. 24, 2020

(51) Int. Cl.

| | |
|---|---|
| ***B67C 3/16*** | (2006.01) |
| ***E03F 1/00*** | (2006.01) |
| ***E03F 5/00*** | (2006.01) |

(52) U.S. Cl.

CPC ..... *E03F 1/006* (2013.01); *E03F 5/00* (2013.01); *Y10T 137/3109* (2015.04)

(58) Field of Classification Search

CPC ..... Y10T 137/3109; E03F 1/006; E03F 1/007
See application file for complete search history.

(56) References Cited

U.S. PATENT DOCUMENTS

| | | | | |
|---|---|---|---|---|
| 3,115,148 A | | 12/1963 | Liljendahl | |
| 3,730,884 A | | 5/1973 | Burns et al. | |
| 3,853,138 A | * | 12/1974 | Amren | E03F 1/006 137/1 |
| 4,171,853 A | | 10/1979 | Cleaver et al. | |
| 4,179,371 A | | 12/1979 | Foreman et al. | |
| 4,373,838 A | | 2/1983 | Foreman et al. | |
| 4,603,709 A | * | 8/1986 | Huisma | E03F 1/006 137/205 |
| 4,691,731 A | | 9/1987 | Grooms et al. | |
| 5,044,836 A | * | 9/1991 | Grooms | E03F 1/007 406/22 |

(Continued)

FOREIGN PATENT DOCUMENTS

| | | |
|---|---|---|
| DE | 20007500 U1 | 9/2000 |
| WO | 2008/057076 A1 | 5/2008 |
| WO | 2017/023421 A1 | 2/2017 |

OTHER PUBLICATIONS

European Patent Office, Invitation to Pay Additional Fees and, Where Applicable, Protest Fee, Jul. 24, 2019, 2 pages.

(Continued)

*Primary Examiner* — Robert K Arundale
(74) *Attorney, Agent, or Firm* — Barnes & Thornburg LLP

(57) ABSTRACT

A vacuum sewage system includes a sump pit for receiving sewage, a valve pit, a valve, a sensor-controller, a first sensor pipe, a sump breather and a second sensor pipe. The sensor-controller activates the valve so as to discharge sewage from the sump pit. The first sensor pipe communicates pressure to the sensor-controller as the level of sewage rises within the sump pit. The second sensor pipe communicates pressure to the sump breather to move the sump breather from a first state to a second state to prevent sewage from entering the sensor-controller and valve. Alternatively, the system may be provided with a single sensor pipe that communicates pressure to both the sensor-controller and to the sump breather.

15 Claims, 12 Drawing Sheets

(56) References Cited

U.S. PATENT DOCUMENTS 5,064,314 A * 11/1991 Grooms ..... E03F 1/007 406/22
5,069,243 A * 12/1991 Foreman ..... G05D 9/04 137/205
5,078,174 A 1/1992 Grooms et al.
5,082,238 A 1/1992 Grooms et al.
5,259,427 A 11/1993 Grooms et al.
5,282,281 A 2/1994 Clear et al.
5,326,069 A 7/1994 Clear et al.
5,570,715 A 11/1996 Featheringill et al.
5,588,458 A * 12/1996 Ushitora ..... E03F 1/006 137/205
5,615,701 A * 4/1997 Yamabe ..... E03F 1/006 137/205
5,979,486 A 11/1999 Davidson
6,311,718 B1 * 11/2001 Hafner ..... F16K 31/08 137/205
6,467,494 B1 * 10/2002 Kolb ..... E03F 1/007 137/12
2004/0226606 A1 * 11/2004 Shimizu ..... E03F 1/007 137/205
2007/0175515 A1 * 8/2007 Lindroos ..... E03F 1/006 137/205
2010/0065131 A1 * 3/2010 Grooms ..... E03F 1/007 137/205
2015/0346734 A1 * 12/2015 Blocher ..... G05D 7/0641 137/565.23
2017/0037611 A1 * 2/2017 Jones ..... E03F 1/007

OTHER PUBLICATIONS

European Patent Office, Partial international Search Report, dated Jul. 24, 2019, 3 pages.
European Patent Office, Provisional Opinion Accompanying the Partial Search Result, dated Jul. 24, 2019, 5 pages.
European Patent Office, International Search Report, dated Sep. 18, 2019, 7 pages.
European Patent Office, Written Opinion of the International Searching Authority, dated Sep. 18, 2019, 10 pages.

* cited by examiner

VACUUM SEWAGE SYSTEM WITH SUMP BREATHER APPARATUS

BACKGROUND OF THE INVENTION

The present invention relates generally to vacuum sewage transport systems for conveying sewage collected in a holding sump to a downstream collection vessel maintained under the influence of vacuum or subatmospheric pressure, and more specifically, to a vacuum sewage system with a sump breather apparatus.

Various vacuum sewage systems are known. Generally speaking, such systems are used to transport sewage and other waste liquids under vacuum or subatmospheric pressure from a source, such as a residential or commercial establishment, to a collection vessel. Examples of such systems are described in U.S. Pat. No. 4,179,371 issued to Foreman et al. and U.S. Pat. No. 5,570,715 issued to Featheringill et al.

SUMMARY OF THE INVENTION

In one embodiment of the present invention, a vacuum sewage system includes a sump pit for receiving sewage from a source of sewage, a valve pit, a valve located in the valve pit, a suction pipe having a first end connected to the valve and a second end extending into the sump pit, a transport pipe having a first end connected to the valve and a second end extending outside the valve pit, a sensor-controller, a first sensor pipe, a sump breather and a second sensor pipe. The sensor-controller selectively opens and closes the valve so as to permit sewage in the sump pit to travel from the sump pit, through the suction pipe to the discharge conduit. The first sensor pipe has a first end extending into the sump pit and a second end extending into the valve pit. The first sensor pipe communicates increased pressure to the sensor-controller as the level of sewage rises within the sump pit. The second sensor pipe has a first end extending into the sump pit and a second end extending into the valve pit. The second sensor pipe communicates pressure to the sump breather to move the sump breather from a first state to a second state to prevent sewage from entering the sensor-controller and valve.

In one embodiment, the first sensor pipe extends into the sump pit a greater distance than the second sensor pipe extends into the sump pit.

In another embodiment, the sump breather includes a housing, a first port for communicating atmospheric pressure from the sump pit to the housing and a second port for communicating atmospheric pressure from the housing to the sensor-controller. In one embodiment, the sump breather includes a diaphragm for selectively opening and closing the first port and the second port in response to increased sewage levels in the sump pit. In another embodiment of the invention, the sump breather includes a third port for communicating increased pressure from the second sensor pipe to the housing of the sump breather.

According to another embodiment of the invention, the diaphragm has a first side and a second side, the first port and the second port are positioned on the first side of the diaphragm and the third port communicates increased pressure to the sump breather housing on the second side of the diaphragm.

In certain embodiments, the system includes a spring for biasing the diaphragm away from the first and second ports.

In other embodiments of the invention, the system includes a switch for producing a signal indicating an abnormal state of operation of the vacuum sewage system. Certain embodiments of the invention include a spring cup located within the sump breather housing. The spring cup is moveable against the force of the spring in response to movement of the diaphragm. In other embodiments, movement of the diaphragm to seal the first port and the second port causes movement of the spring cup to activate the switch.

In other embodiments, the system includes a relief valve to prevent delayed operation of the sump breather. The relief valve prevents delayed operation of the sump breather by releasing excess pressure build up in the sump pit.

In one embodiment of the present invention, a vacuum sewage system includes a sump breather apparatus having a sensor pipe and a sump breather. The sump breather includes a housing having a first member and a second member, a first port communicating with the interior of the housing, the first port extending from the first member of the housing, a diaphragm located in the housing, the diaphragm having a first side and a second side, and a switch for producing a signal indicating an abnormal state of operation of the vacuum sewage system.

In one embodiment, the first port communicates with the interior of the housing on the first side of the diaphragm and the sump breather further includes second, third, fourth, fifth and sixth ports extending from the second member of the housing. The second, third, fourth, fifth and sixth ports communicate with the interior of the housing on the second side of the diaphragm.

According to another embodiment, the system further includes a spring that biases the diaphragm toward the first member of the housing.

In other embodiments, the diaphragm moves in response to pressure communicated to the interior of the housing toward the second member of the housing to seal the third, fourth, fifth and sixth ports.

In one embodiment, the system further includes a spring cup and movement of the diaphragm toward the second member of the housing causes the spring cup to activate the switch.

In one embodiment, the system further includes a relief valve to prevent delayed operation of the sump breather.

In certain embodiments, the vacuum sewage system includes a sump pit for receiving sewage from a source of sewage, a valve pit, a valve located in the valve pit, a suction pipe having a first end connected to the valve and a second end extending into the sump pit, a transport pipe having a first end connected to the valve and a second end extending outside the valve pit and a sensor-controller located in the valve pit, the sensor-controller selectively opens and closes the valve so as to permit sewage in the sump pit to travel from the sump pit, through the suction pipe to the discharge conduit. The sensor pipe communicates increased pressure in the sump pit to the sensor-controller to activate the sensor-controller. In one embodiment, the sensor pipe communicates increased pressure in the sump pit to the sump breather to activate the sump breather. In another embodiment, the sensor-controller is activated at a lower pressure than is the sump breather during normal operation of the sensor-controller.

Other features of the present invention will be apparent from the following description of embodiments of the invention and accompanying drawings.

DETAILED DESCRIPTION OF EMBODIMENTS OF THE INVENTION

Figure 1:
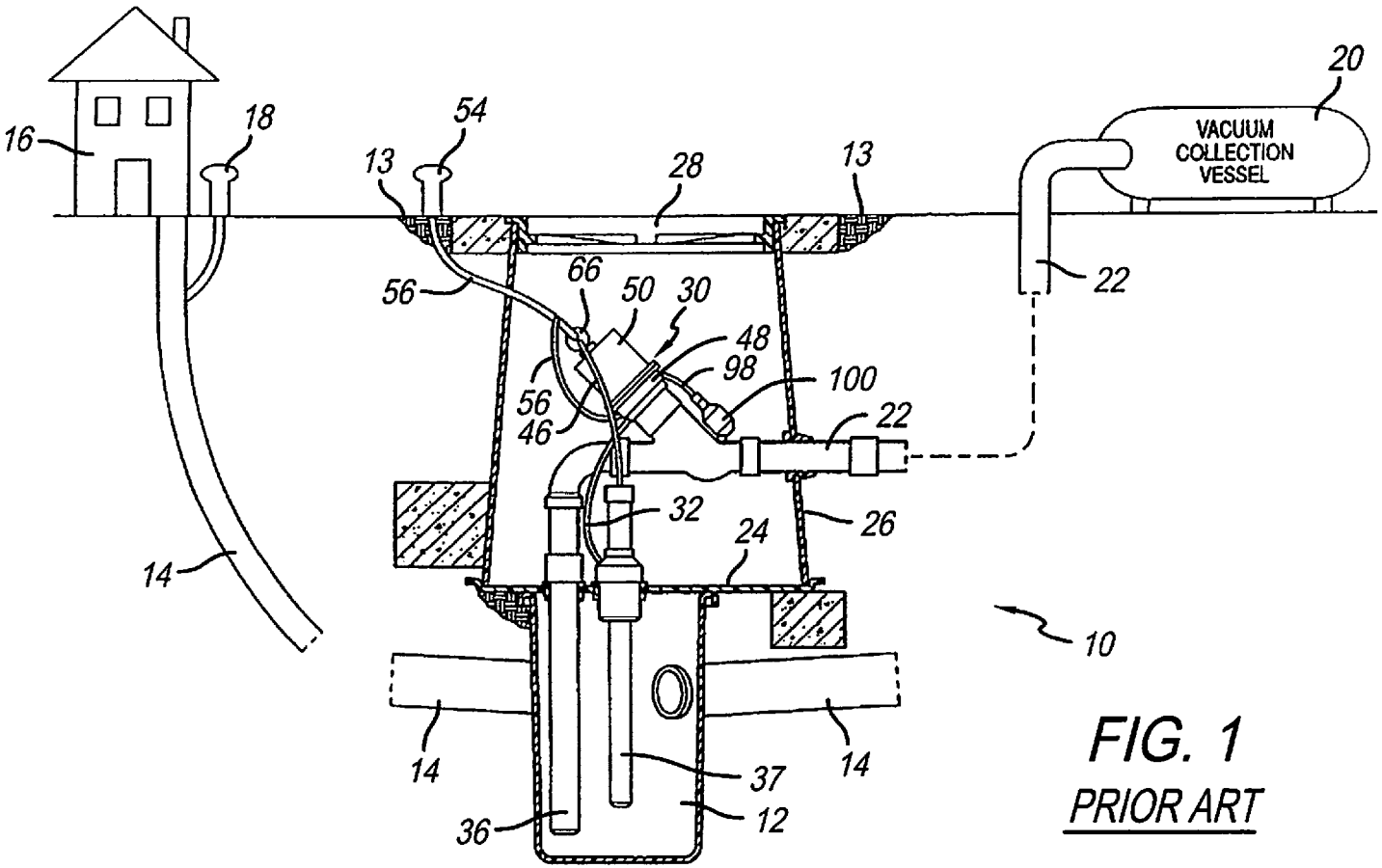
FIG. 1 PRIOR ART
FIG. 1 illustrates a prior art vacuum sewage transport system including an interface valve, sensor-controller, and above-ground breather pipe.
Figure 2:
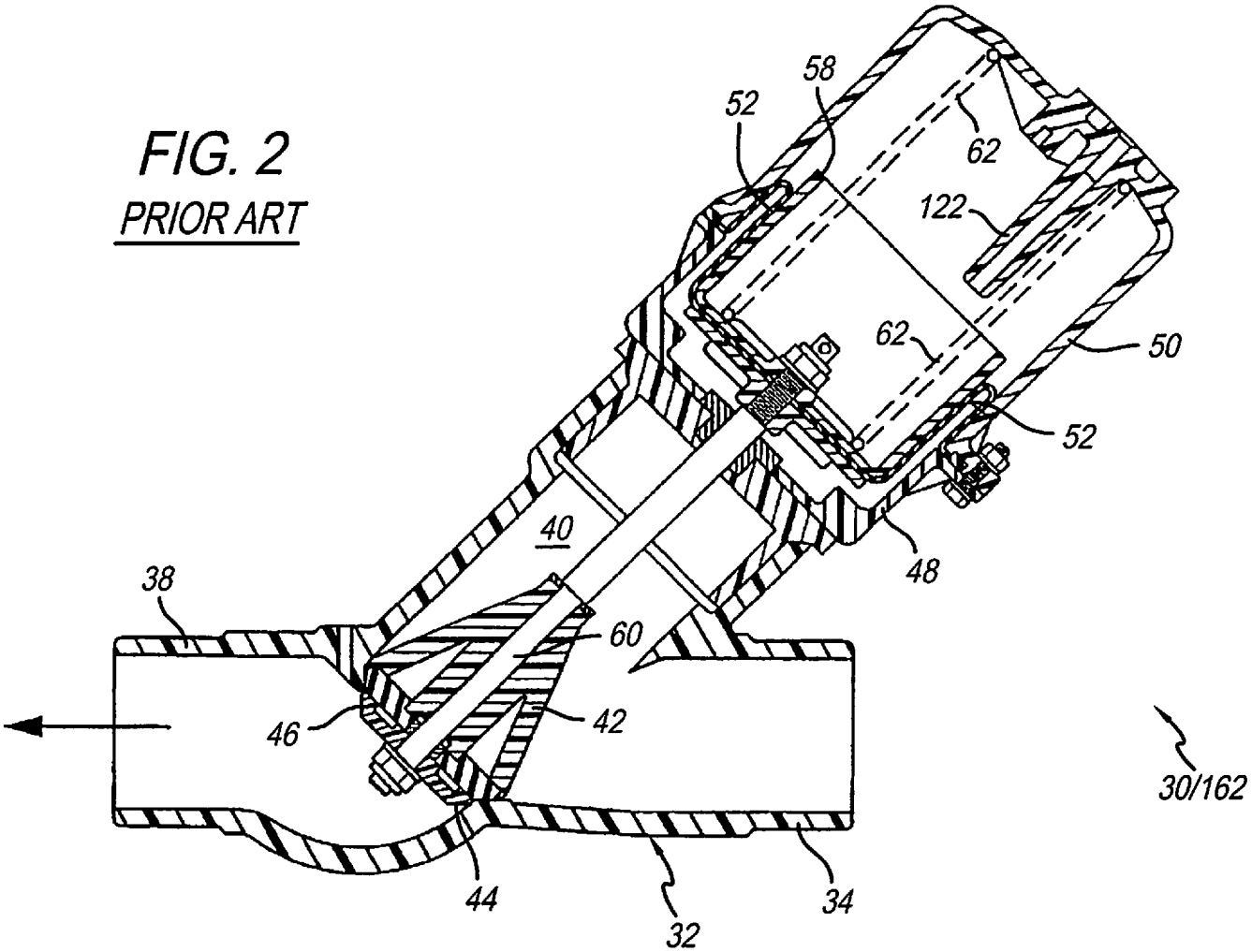
FIG. 2 PRIOR ART
FIG. 2 is a cross-sectional view of a prior art interface valve in the closed position.

FIGS. 1-5 illustrate a prior art vacuum sewage system and certain components of the system. As shown more fully in FIG. 1, vacuum sewage system 10 comprises a sump pit 12 buried beneath ground level 13 to which are connected a plurality of gravity lines 14 emanating from sewage sources 16. External gravity vent 18 positioned above ground ensures that sewage reaches sump pit 12 at atmospheric pressure.

Located above ground a distance away is a vacuum collection station containing a collection vessel 20 maintained at vacuum or subatmospheric pressure by means of vacuum pumps. Vacuum collection vessel 20 is operatively connected to sump pit 12 by means of a vacuum transport conduit 22. The vacuum transport conduit may be laid in a number of configurations. For example, it may be provided with "pockets" in which the sewage is collected so as to form a plug that entirely fills the cross-sectional bore of the conduit. The sewage plug is moved by means of differential pressure through the conduit in an integral condition. U.S. Pat. No. 3,115,148 issued to Liljendahl, and U.S. Pat. No. 3,730,884 issued to Burns et al. disclose such "plug-flow" systems. More preferably, the conduit portion leading to each pocket or low point is sloped such that the low point will not be filled with sewage upon completion of a sewage transport cycle, and an equalized vacuum or subatmospheric pressure condition is communicated instead throughout the conduit network. As taught by U.S. Pat. No. 4,179,371 issued to Foreman et al., a sewage/air mixture in such a "two-phase flow" system is swept along the conduit during a transport cycle.

A top panel 24 of sump pit 12 is connected to the sidewalls thereof. Positioned on top of the top panel 24 is valve pit 26, which is accessed at ground level by a manhole cover 28. Located within valve pit 26 is vacuum interface valve 30. Examples of interface valves may be found in U.S. Pat. No. 4,171,853 issued to Cleaver et al., and U.S. Pat. Nos. 5,078,174, 5,082,238 issued to Grooms et al, U.S. Pat. Nos. 5,259,427, 5,326,069 and 5,282,281. As shown generally in FIG. 2, it comprises a conduit 32 having an inlet 34 which is operatively connected to sump pit 12 by a suction pipe 36, and an outlet 38, which is operatively connected to vacuum transport conduit 22. Positioned within valve housing 40 is plunger 42, which may be conically shaped. An elastomeric seat 44 is attached to one end of plunger 42, and cooperates with valve stop 46 of wye-body conduit 32 to regulate passage of sewage through interface valve 30. Secured to the top of valve housing 40 is lower housing 48 and upper housing 50, which are divided by an elastomeric diaphragm 52. Lower housing 48 is always maintained at atmospheric pressure by an externally mounted breather pipe 54 and atmospheric hose 56. Plunger 42 is connected to piston cup 58 by a piston shaft 60, and a spring 62 positioned between the interior of piston cup 58 and the top of upper housing 50 biases valve seat 44 against valve stop 46 to close interface valve 30 when upper housing 50 is at atmospheric pressure. However, once upper housing 50 is switched to a vacuum or subatmospheric pressure condition, diaphragm 52—and consequently piston cup 58, piston shaft 60, plunger 42, and valve seat 44 is moved away from valve stop 46 by means of differential pressure to open interface valve 30 to commence a sewage transport cycle.

Figure 3:
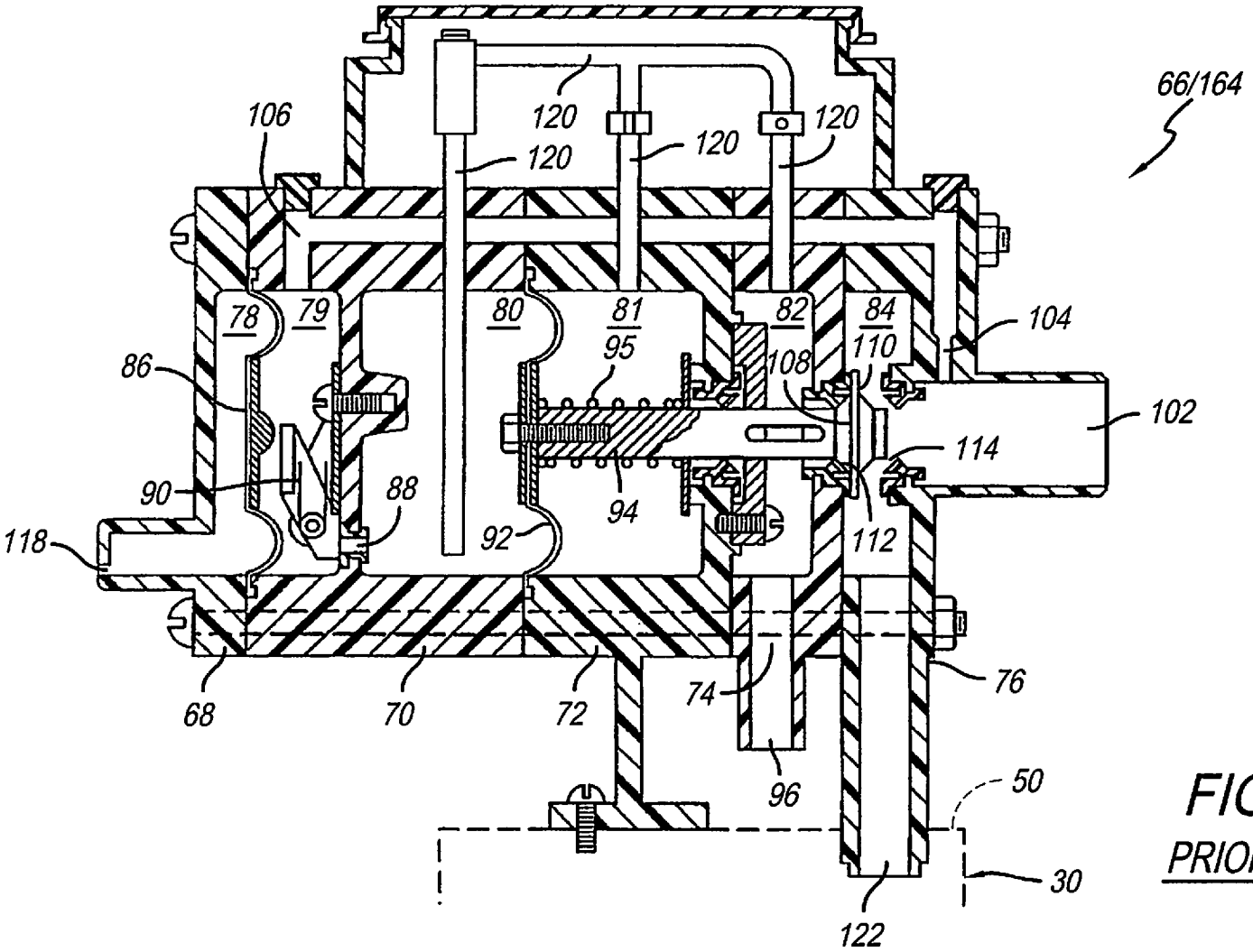
FIG. 3 PRIOR ART
FIG. 3 is a cross-sectional view of a prior art sensor-controller in the inactivated position.
Figure 4:
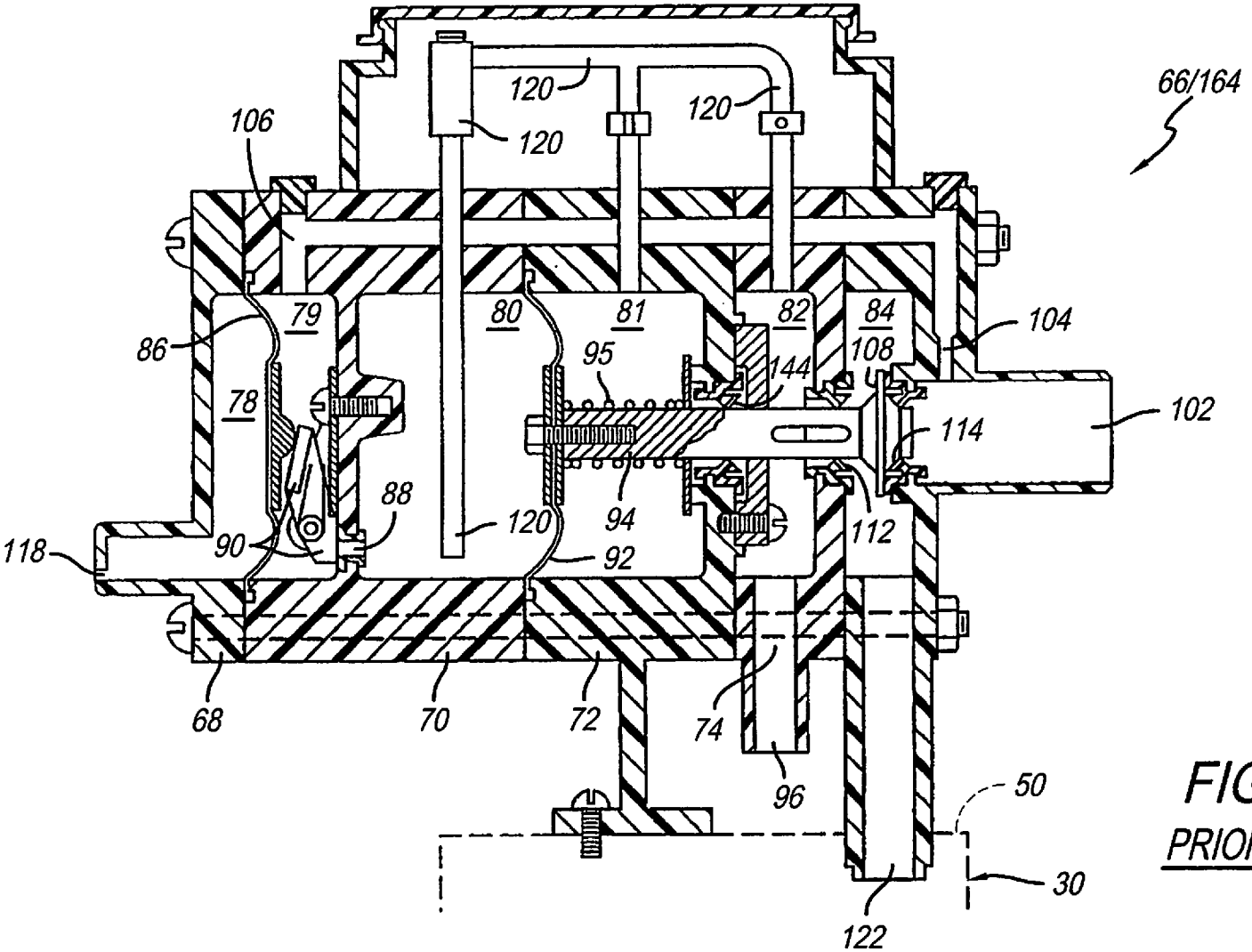
FIG. 4 PRIOR ART
FIG. 4 is a cross-sectional view of a prior art sensor-controller in the activated position.

Sensor-controller 66 is used to deliver a vacuum/subatmospheric or atmospheric pressure condition to upper housing 50 so to open or close interface valve 30 in response to the sewage level in sump pit 12. The structure of sensor-controller 66 is described more fully in U.S. Pat. No. 4,373,838 issued to Foreman et al. As shown in FIGS. 3-4, the structure and mode of operation are generally as follows. A plurality of body elements 68, 70, 72, 74, and 76 cooperate to form hydrostatic pressure chamber 78, sensor chamber 79, chamber 80, chamber 81, vacuum chamber 82, and valve chamber 84. Chambers 78 and 79 are divided an elastomeric diaphragm 86. Chambers 79 and 80 communicate by means of a port 88, which may be closed by spring biased lever valve 90 (FIG. 3). Chambers 80 and 81 are divided by an elastomeric diaphragm 92 to which is attached piston rod 94 that extends through chamber 81, chamber 82, and into chamber 84. Vacuum chamber 82 is maintained at vacuum or subatmospheric pressure by means of vacuum inlet port 96 and vacuum hose 98 which is attached to vacuum transport conduit 22. Surge tank 100 may be interposed in vacuum hose 98 to prevent sewage from entering vacuum chamber 82. Atmospheric inlet port 102 delivers atmospheric pressure to sensor-controller 66 by means of atmospheric hose 56 connected to external breather pipe 54. Atmospheric pressure, in turn, is delivered to sensor chamber 79 by means of inlet 104 and atmospheric conduit 106.

To the other end of piston rod 94 is connected three-way valve seat 108 made from a plastic material. Flange 110 on valve seat 108 is positioned between elastomeric seals 112 and 114 which communicate vacuum/subatmospheric and atmospheric pressure from vacuum chamber 82 and atmospheric inlet port 102, respectively, to valve chamber 84.

Sensor-controller 66 is shown in the closed position in FIG. 3. Hose 116 connected to sensor pipe 37 communicates the hydrostatic pressure level in sump pit 12 to chamber 78 through inlet port 118. Meanwhile, sensor chamber 79 is at atmospheric pressure. The vacuum/subatmospheric pressure condition of vacuum chamber 82 is communicated to chambers 80 and 81 by a vacuum conduit 120. Flange 110 of valve seat 108 closes vacuum vent 112, and opens atmospheric vent 114 to allow atmospheric pressure to pass into valve chamber 84, and therefore into upper valve housing 50 through pressure vent 122.

Once the hydrostatic pressure communicated to chamber 78 rises to a predetermined level, diaphragm 86 is biased into contact with lever valve 90, which in turn is activated to open port 88 so that the vacuum/subatmospheric pressure in chamber 80 is replaced with the atmospheric pressure condition of sensor chamber 79 (FIG. 4). This creates a differential pressure across diaphragm 92, which pushes piston rod 94 so that valve flange 110 closes atmospheric vent 114 and opens vacuum vent 112, whereupon vacuum/subatmospheric pressure is delivered into vacuum chamber 84, and through pressure vent 122 into upper valve housing 50 to open interface valve 30 to commence a sewage transport cycle. Meanwhile, vacuum/subatmospheric pressure in vacuum chamber 82 is leaked through vacuum conduit 120 into chamber 80 to replace the atmosphere pressure therein, and once it reaches a sufficient level, the process is reversed to return sensor-controller 66 to the closed position shown in FIG. 3 to terminate the sewage transport cycle.

Figure 5A:
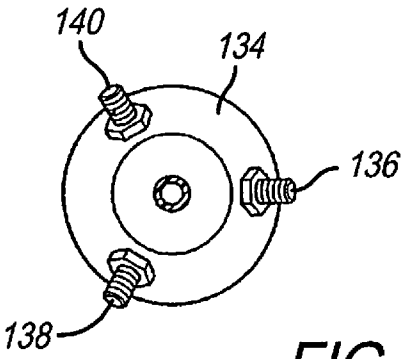
FIG. 5A PRIOR ART
FIG. 5*a* is a plan view of the prior art in-pit breather system collar taken along line 5*a*-5*a* in FIG. 5.
Figure 5:
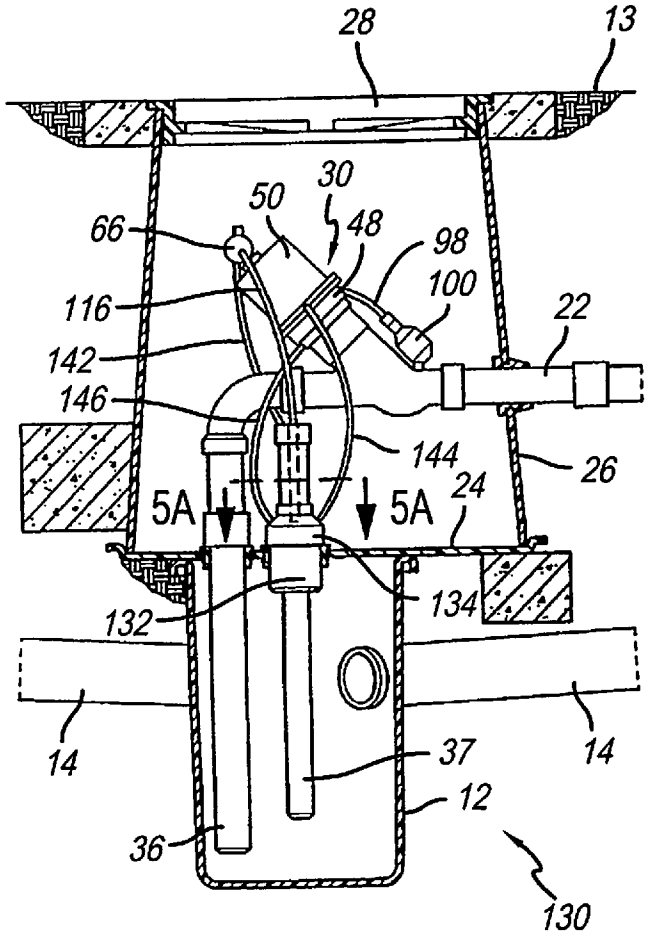
FIG. 5 PRIOR ART
FIG. 5 illustrates a prior art vacuum sewage transport system including an interface valve, sensor-controller, and in-pit breather system.

U.S. Pat. No. 4,691,731 issued to Grooms et al. describes another vacuum sewage system having a sump/valve pit structure 130, as shown in FIG. 5, in which breather pipe 54 is eliminated, and instead, atmospheric pressure is supplied by sump pit 12. More specifically, sensor pipe 37 is secured to sump pit top panel 24 by means of a sleeve 132 and collar 134 assembly. Collar 134 has three nozzles 136, 138, and 140 extending therefrom (FIG. 5*a*). Breather tube 142 is attached to nozzle 136 and atmospheric inlet port 102 of sensor-controller 66 (FIGS. 3 & 4), thereby allowing atmospheric pressure contained in sump pit 12 to be freely communicated to the sensor-controller. Vent tube 144, in turn, is attached to nozzle 138 and lower housing 48 of interface valve 30, thereby providing atmospheric pressure thereto. Finally, drainage tube 146 may be attached to lower housing 48 and nozzle 140, ensuring that any moisture that condenses within lower housing 48 may be easily drained back through sensor pipe 37 into sump pit 12. Under normal operating conditions, this "in pit breather" arrangement provides atmospheric pressure to sensor-controller 66 and interface valve 30 without above-ground breather pipe 54.

Problems arise, however, if the vacuum/subatmospheric pressure condition within vacuum transport conduit 22 diminishes to a low vacuum condition. Referring to FIGS. 3-4, once the hydrostatic pressure condition delivered to chamber 78 by sensor pipe 37 and pressure tube 116 reaches the predetermined level as sewage accumulates in sump pit 12, diaphragm 86 is biased to open lever valve 90, and chamber 80 is converted to atmospheric pressure (i.e., 0 vacuum), while chamber 81 is at low vacuum. The differential pressure across valve diaphragm 92 is too small to overcome the counterforce exerted by spring 95 to move piston rod 94 and valve head 108 sufficiently to completely close off atmospheric vent 114. Moreover, the low vacuum pressure passed through vacuum vent 112 and pressure vent 122 into upper housing 50 is insufficient to open interface valve 30. Not only can sewage not be evacuated from sump pit 12 through suction pipe 36 and closed interface valve 30 to vacuum transport conduit 22, but also sewage continues to collect in the sump.

Once the sewage level in sump pit 12 rises to a sufficient level, positive pressure therein pushes sewage through breather tube 142 to atmospheric inlet port 102 of sensor-controller 66. The atmospheric pressure in sensor valve chamber 79 will temporarily keep the sewage from entering it via atmospheric conduit 106. However, once lever valve 90 is opened when the sensor-controller valve is fired, atmospheric pressure leaks from sensor valve chamber 79 into chamber 80. Moreover, atmospheric pressure can leak from sensor valve chamber 79 through vacuum conduit 120, vacuum hose 98, and surge tank 100 into vacuum transport conduit 22. By reducing the atmospheric pressure condition in sensor valve chamber 79, sewage may now enter it and the rest of the sensor-controller chambers through the aforementioned paths to ensure that sensor-controller 66 cannot operate properly until it is manually drained by service personnel.

Thus, U.S. Pat. No. 4,691,731 also discloses a sump-vent valve which may be interposed within vacuum hose 98, and is closed by a low vacuum condition to prevent communication of the low vacuum to sensor-controller 66 which can cause atmospheric pressure in sensor valve chamber 79 to leak, and thereby compromise the sealed nature of chamber 79 that otherwise keeps sewage out of sensor-controller 66.

It has been found, however, that several problems can arise in operation of this system. First, the sump-vent valve is typically set to close at the correct time once a low vacuum pressure condition arises. For example, if 5 inches of vacuum is required to operate sensor-controller 66, and the sump-vent valve is set to close at 6 inches of vacuum, then the system works. However, if over time the sump-vent valve begins to close at 4½ inches of vacuum, then it is not activated soon enough as the vacuum pressure within the system 10 drops, and low vacuum can be communicated to sensor-controller 66 to allow sewage to enter it, despite the presence of the sump-vent valve.

Second, even if the sump-vent valve operates properly, once full vacuum is restored to the system, sensor-controller 66 will be activated to the open position in response to the elevated hydrostatic pressure condition in chamber 78. Some atmospheric pressure will be consumed in the process, which will cause sewage to be pulled through breather tube 142 into sensor-controller 66.

Third, breather tube 142 is connected to the top of sensor pipe 37 that extends through sump pit top 24. If the seal between sleeve 132 and top 24 fails, then atmospheric pressure can leak out of sump pit 12 into valve pit 26. This permits even more sewage to collect in sump pit 12 if the low vacuum condition that renders sensor-controller 66 and interface valve 30 inoperative by the sump-vented valve persists over an extended period of time. Once full vacuum is restored, and sensor-controller 66 is activated, enough atmospheric pressure can leak within sensor-controller 66 to draw sewage into it, as previously described.

Another problem arises if gravity line 14 is installed improperly or settles over time to create a dip therein. If the cross-sectional bore of the dipped portion becomes filled with sewage, then atmospheric pressure from gravity vent pipe 18 cannot be communicated to sump pit 12 to be passed to sensor-controller 66 and interface valve 30. This could prevent the sensor-controller and interface valve from operating properly. Furthermore, if hydrostatic pressure builds sufficiently in sump pit 12, then it, and not atmospheric pressure, can be communicated to atmospheric inlet port 102 of sensor-controller 66. Thus, hydrostatic pressure would be communicated to both ends of sensor-controller 66, and then to chambers 78 and 79, which would render sensor-controller 66 completely inoperative.

FIGS. 6-10 illustrate a sump breather apparatus according to embodiments of the present invention that addresses the potential issues discussed above and prevents sewage from entering vacuum interface valve 30 and sensor-controller 66.

Figure 6:
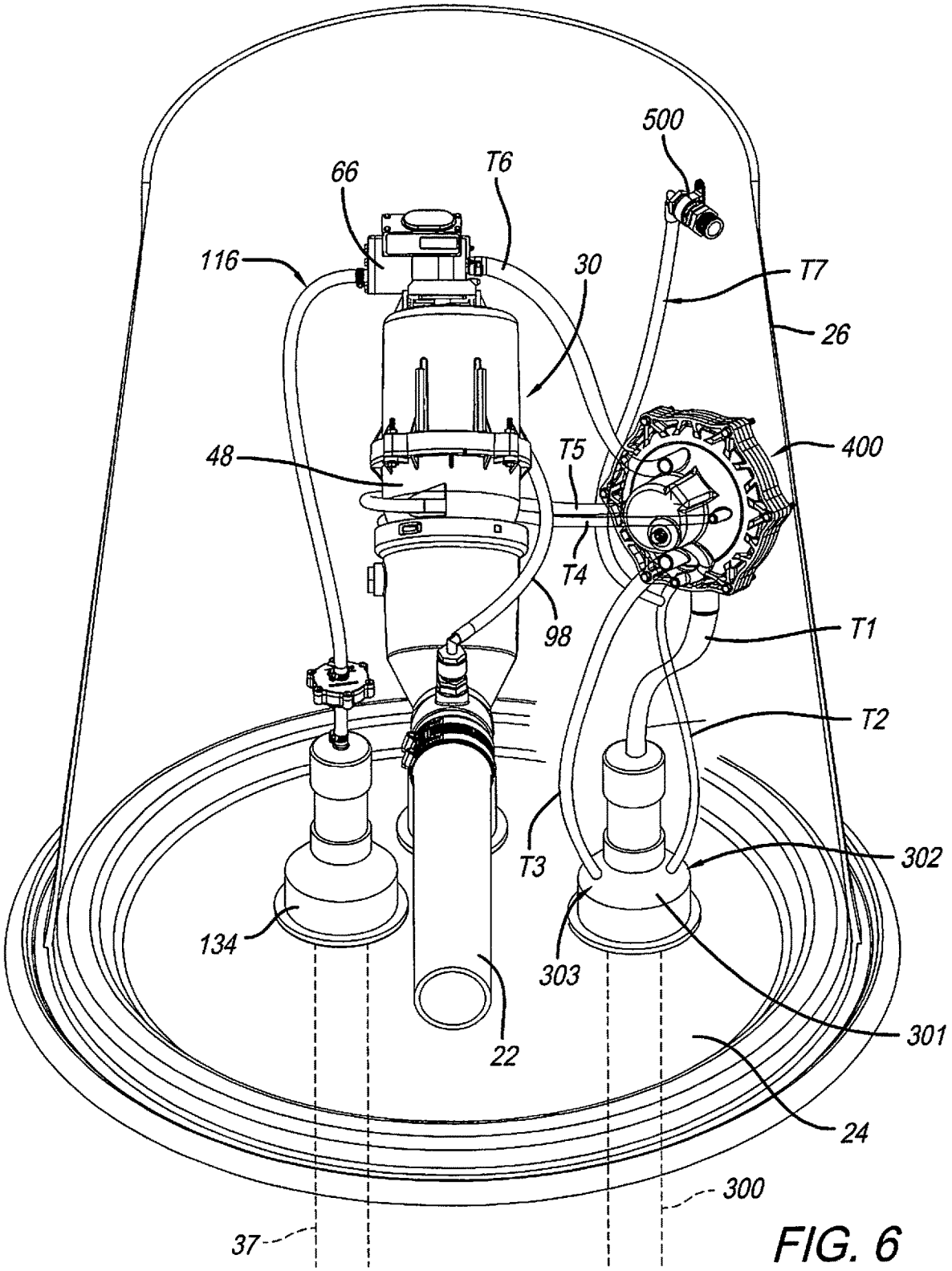
FIG. 6 illustrates components of a vacuum sewage system according to one embodiment of the present invention.
Figure 7:
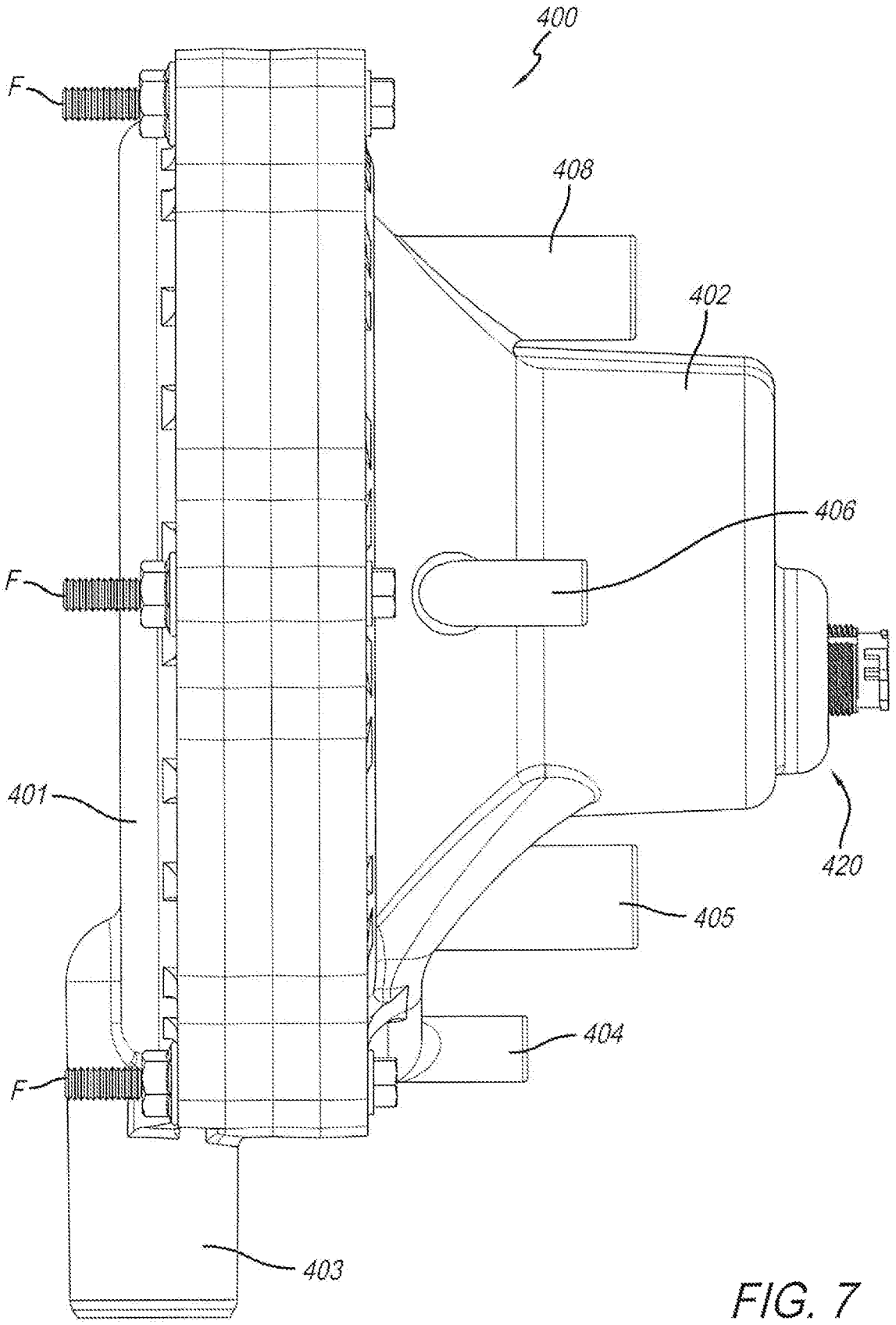
FIG. 7 is a side elevational view of a sump breather that is a component of a vacuum sewage system according to one embodiment of the present invention.
Figure 8:
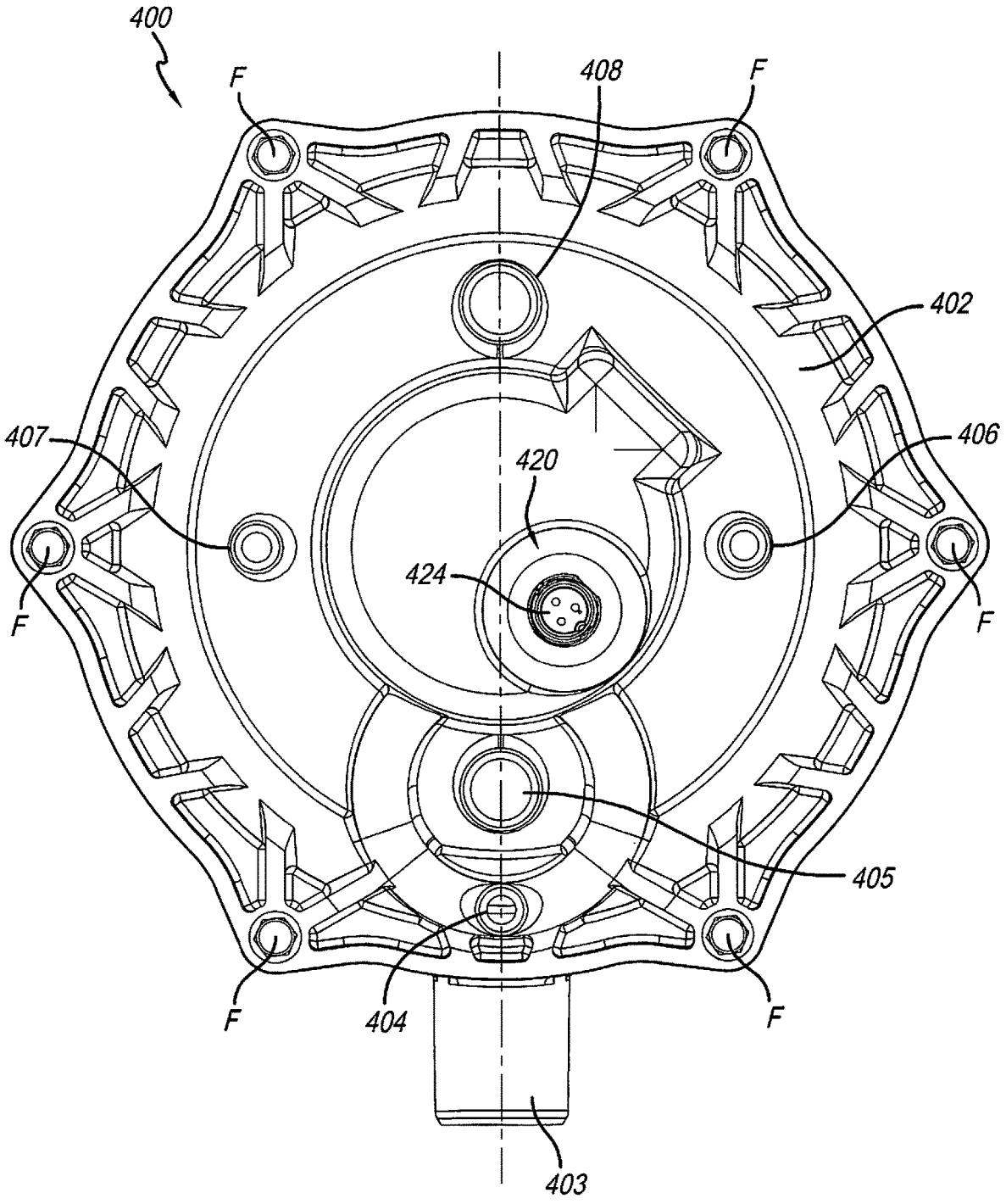
FIG. 8 is a front elevational view of the sump breather of FIG. 7.

As shown in FIG. 6, sump breather apparatus 200 includes a second sensor pipe 300, a sump breather 400 and a relief valve 500.

Second sensor pipe 300 is secured to sump pit top panel 24 by a sleeve and a collar 301 similar to those describe above in connection with FIGS. 5 and 5*a*. The lower section of collar 301 has a larger diameter than the exterior of second sensor pipe 300, which results in a space between the exterior surface of second sensor pipe 300 and the interior surface of the lower section of collar 301. Collar 301 has a first nozzle 302 and a second nozzle 303. First nozzle 302 and second nozzle 303 open into the space between second sensor pipe 300 and collar 301. Second sensor pipe 300 is shorter than sensor pipe 37. In this embodiment, sensor pipe 37 is secured to sump pit top panel 24 by sleeve 132 and collar 134. However, collar 134 is not provided with any nozzles.

Sump breather 400 generally includes a housing having a first member 401 and a second member 402 connected by bolts or other fasteners F. Sump Breather 400 further includes a first port 403, a second port 404, a third port 405, a fourth port 406, a fifth port 407 and a sixth port 408. First port 403 extends from and may be integral with first member 401 of the housing of sump breather 400. Second port 404, third port 405, fourth port 406, fifth port 407 and sixth port 408 extend from and may be integral with second member 402 of the housing of sump breather 400.

Figure 9:
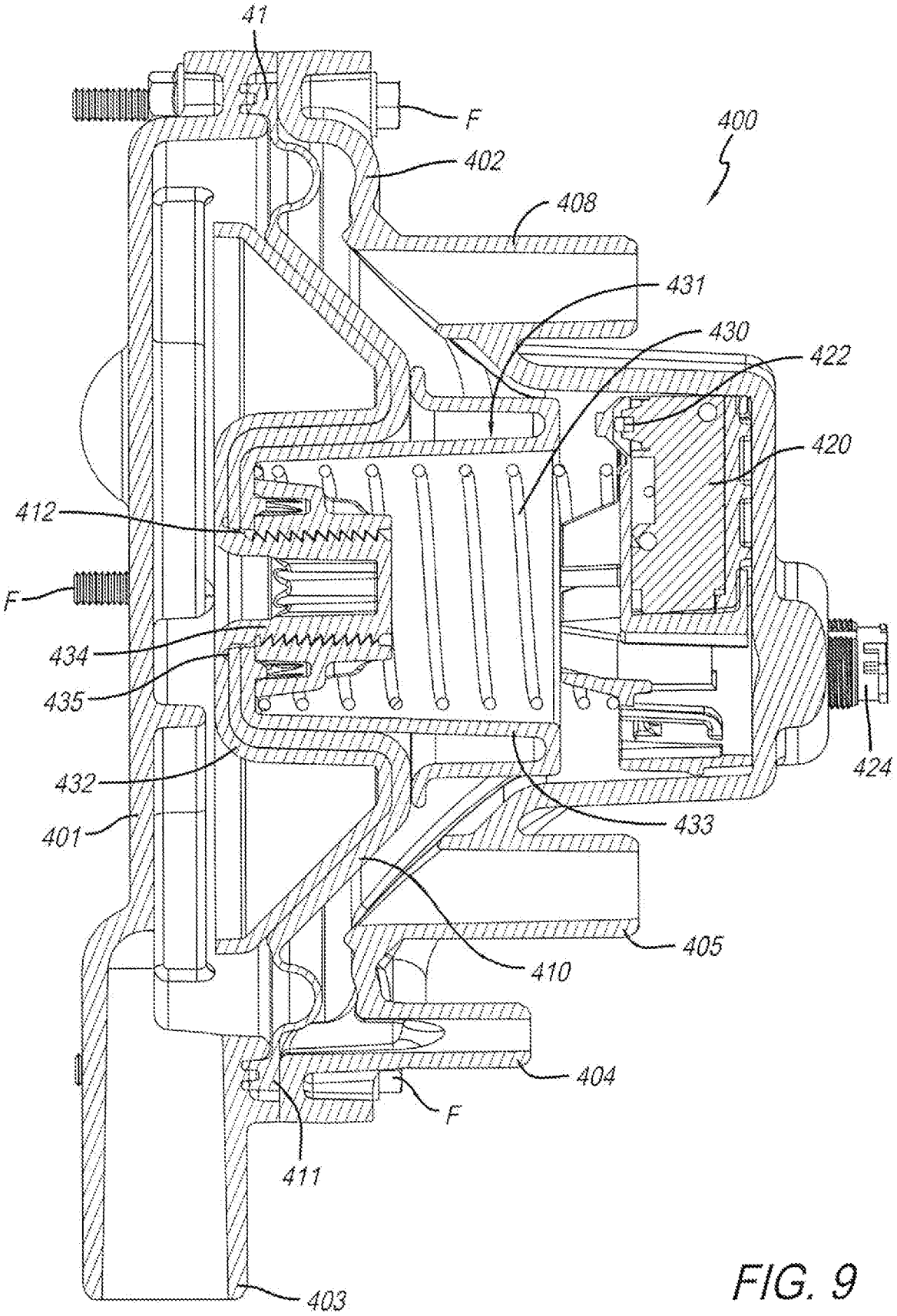
FIG. 9 is a cross-sectional view of the sump breather of FIG. 7 in the inactive position.
Figure 10:
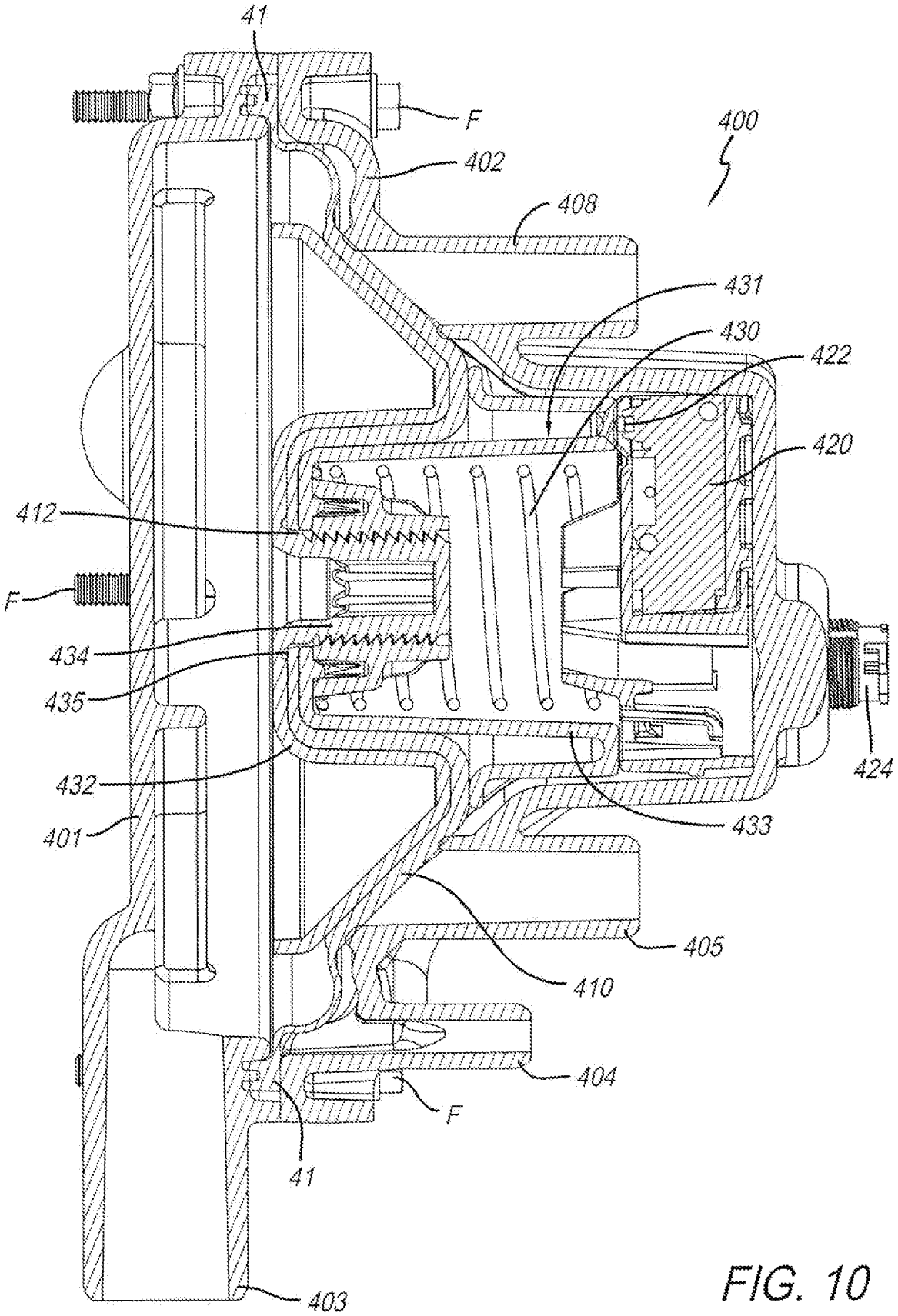
FIG. 10 is a cross-sectional view of the sump breather of FIG. 7 in the active position.

As shown in FIGS. 9 and 10, a diaphragm 410 is secured within the housing of sump breather 400 between first member 401 and second member 402 by sandwiching perimeter 411 of diaphragm 410 between first member 401 and second member 402 around the perimeter thereof. Diaphragm 410 further includes a central opening 412.

Sump breather 400 also includes a switch assembly 420 supported within second member 402 of the housing of sump breather 400. Switch assembly 420 includes a moveable switch element 422 and an electrical connector 424.

Sump breather apparatus 200 further includes a spring 430 and spring cup 431. Spring cup 431 includes a first member 432 and a second member 433. First member 432 includes a threaded protrusion or boss 434 which extends through opening 412 in diaphragm 410 and through an opening 435 in second member 433 of spring cup 431. First member 432 and second member 433 of spring cup 431 are secured together by engaging a nut or threaded retaining member 436 on threaded boss 434 of first member 432. Spring 430 is surrounds boss 434 and is captured between second member 433 of spring cup 431 and support structure 421. Spring 430 biases spring cup 431 and diaphragm 410 so as to position diaphragm 410 away from third port 405 and sixth port 408 as shown in FIG. 9.

A first tube T1 connects first port 403 to second sensor pipe 300 and communicates pressure in sensor pipe 300 to first port 403. A second tube T2 connects second port 404 to first nozzle 302 of collar 301 and permits liquid to drain from sensor-controller 66, through sump breather 400, through first nozzle 302 and into sump pit 12 via the space between the exterior surface of sensor pipe 300 and the lower section of collar 301. A third tube T3 connects third port 405 to second nozzle 303 of collar 301 and supplies atmospheric pressure to sump breather 400 on one side of diaphragm 410. A fourth tube T4 is connected to fourth port 406 and a fifth tube 15 is connected to fifth port 407. Fourth tube T4 and fifth tube T5 are connected at their opposite ends to lower housing 48 and communicate atmospheric pressure to lower housing 48. A sixth tube T6 is connected to sixth port 408 and to the atmospheric inlet port 102 of sensor-controller 66. A seventh tube T7 is connected at one end to relief valve 500 and at the other end to tube T2.

When the amount of sewage in sump pit 12 is at normal levels for proper operation of the vacuum sewage system, the pressure in second sensor pipe 300 will be zero. This is because second sensor pipe 300 is shorter than sensor pipe 37 and, therefore, does not extend as far into sump pit 12 as does sensor pipe 37. Stated another way, sewage in sump pit 12 will reach the opening of sensor pipe 37 and increase the pressure therein before it reaches the opening of second sensor pipe 300 and increases the pressure therein.

When the sewage level in sump pit 12 becomes abnormally high, it will enter second sensor pipe 300 and communicate higher pressure through first port 403 to diaphragm 410. As the pressure continues to increase, diaphragm 410 and spring cup 431 will be pushed toward the right as shown in FIGS. 9 and 10 against the force of spring 430. Ultimately, diaphragm 410 will close third port 405 and sixth port 408 as shown in FIG. 10. Diaphragm 410 will also close fourth port 406 and fifth port 407. As a result, any sewage that enters sump breather 400 is contained on one side of diaphragm 400 and is unable to enter interface valve 30 or sensor-controller 66. Furthermore, as spring cup 431 moves to the right, it will activate switch element 422 and send a signal through electrical connector 424 to a control system to provide notification that the vacuum sewage system is not working properly.

When the operational problem is corrected, sensor-controller 66 will cycle and will reduce the sewage level in sump pit 12 to normal operational levels. This will in turn lower the pressure in second sensor pipe 300, which will cause diaphragm 410 to move away from third port 405, fourth port 406, fifth port 407 and sixth port 408 back to the position shown in FIG. 9. Sensor-controller 66 will then return to normal operation.

Note that relief valve 500 prevents delayed operation of sump breather 400 by releasing pressure build up in pit 12 that exceeds a specified level. Stated another way, if the pressure build up in pit 12 is such that it would prevent activation of sump breather 400, relief valve 500 will release the excess pressure in pit 12, thereby allowing activation of sump breather 400.

Figure 11:
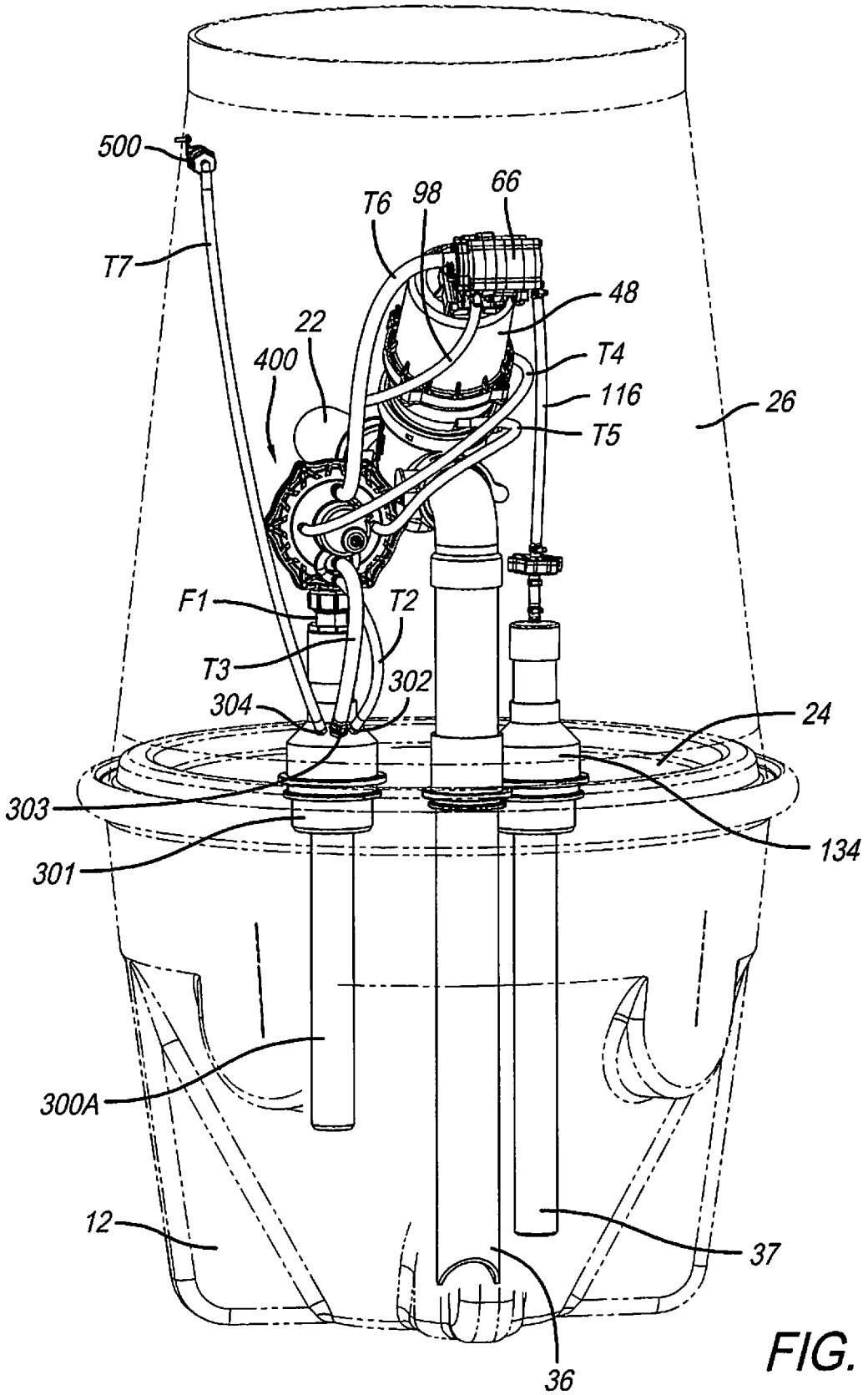
FIG. 11 illustrates components of a vacuum sewage system according to another embodiment of the present invention.

FIG. 11 illustrates another embodiment of the present invention. In this embodiment, first tube T1 is eliminated and first port 403 of sump breather 400 is connected to second sensor pipe 300 by a fitting F1. Collar 301 is provided with a third nozzle 304 and seventh tube T7 is connected at one end to third nozzle 304 and at the opposite end to relief valve 500.

Figure 12:
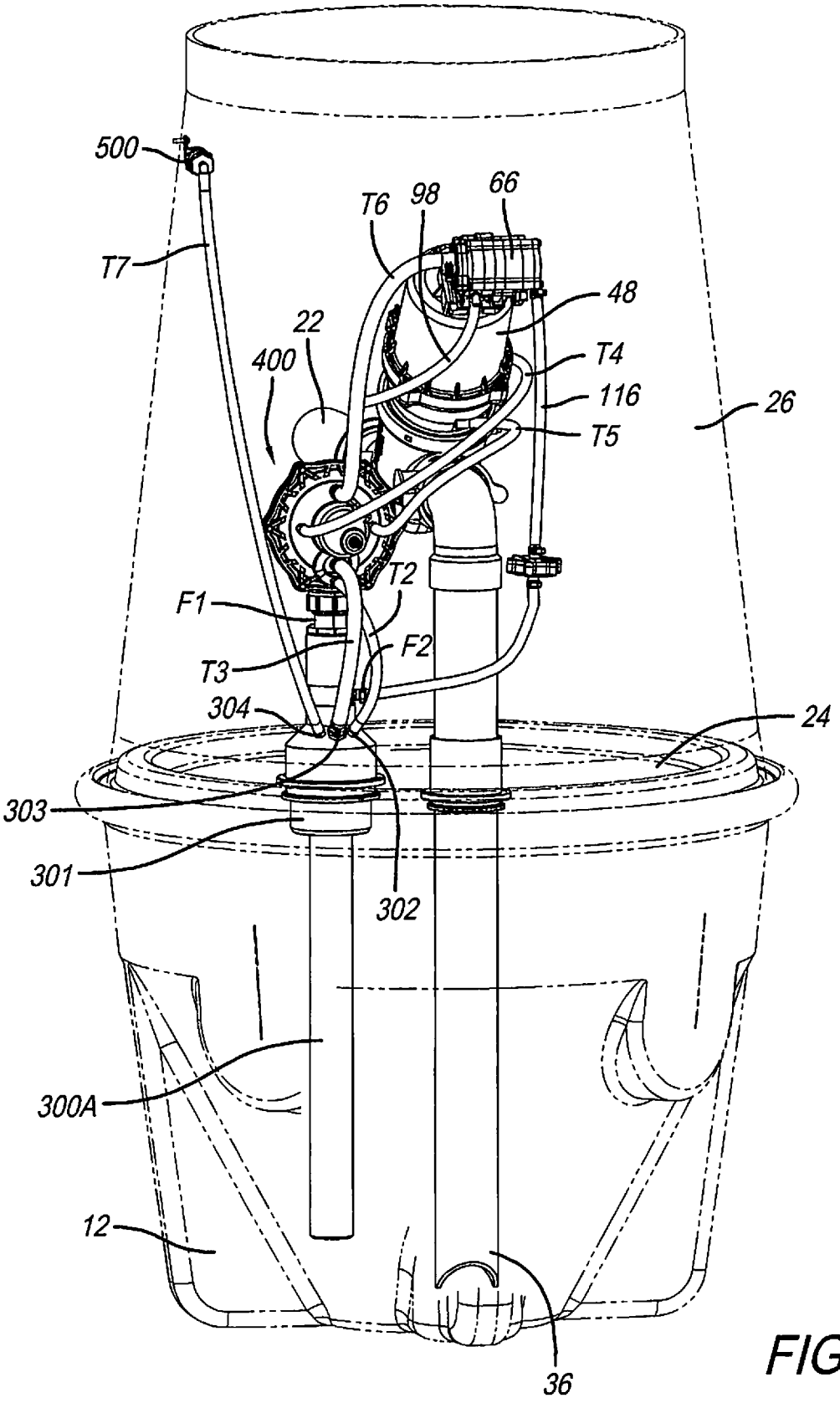
FIG. 12 illustrates components of a vacuum sewage system according to another embodiment of the present invention.

FIG. 12 illustrates another embodiment of the present invention. In this embodiment, a single sensor pipe 300A is utilized. One end of hose 116 is connected to sensor-controller 66 and the opposite end is connected by a fitting F2 to sensor pipe 300A. Pressure is communicated from pit 12, through sensor pipe 300A and hose 116 to sensor-controller 66 to operate sensor-controller 66 as described above. A single sensor pipe can be used in this manner because operation of sump breather 400 is triggered at a higher pressure than is operation of sensor-controller 66.

Although the present invention has been shown and described in detail, the same is for purposes of illustration only and should not be taken as a limitation on the invention. Numerous modifications can be made to the embodiments disclosed without departing from the scope of the invention.

What is claimed is:

1. A vacuum sewage system including: a sump pit for receiving sewage from a source of sewage; a first sensor pipe for sensing pressure extending into the sump pit; and a sump breather, the sump breather including: a housing having a first member and a second member; a first port communicating with the interior of the housing, the first port extending from the first member of the housing; a second sensor pipe for sensing pressure extending into the sump pit, the second sensor pipe connected to the first port; a diaphragm located in the housing, the diaphragm having a first side and a second side; and a switch for producing a signal indicating an accumulation of sewage in the sump pit resulting in increased pressure in the first sensor pipe and in the second sensor pipe.

2. The vacuum sewage system according to claim 1, wherein the first port communicates with the interior of the housing on the first side of the diaphragm and wherein the sump breather further includes second, third, fourth, fifth and sixth ports extending from the second member of the housing, the second, third, fourth, fifth and sixth ports communicating with the interior of the housing on the second side of the diaphragm.

3. The vacuum sewage system according to claim 2, further including a spring and wherein the spring biases the diaphragm toward the first member of the housing.

4. The vacuum sewage system according to claim 3, wherein the diaphragm moves in response to pressure communicated to the interior of the housing toward the second member of the housing to seal the third, fourth, fifth and sixth ports.

5. The vacuum sewage system according to claim 4, further including a spring cup and wherein movement of the diaphragm toward the second member of the housing causes the spring cup to activate the switch.

6. The vacuum sewage system according to claim 5, further including a relief valve to prevent delayed operation of the sump breather.

7. A vacuum sewage system including:

a sump pit for receiving sewage from a source of sewage;

a sensor pipe;

a valve pit;

a valve located in the valve pit;

a suction pipe having a first end connected to the valve and a second end extending into the sump pit;

a transport pipe having a first end connected to the valve and a second end extending outside the valve pit;

a sensor-controller located in the valve pit, the sensor-controller selectively opening and closing the valve so as to permit sewage in the sump pit to travel from the sump pit, through the suction pipe to the transport pipe;

a sump breather, the sump breather including:

a housing having a first member and a second member;

a first port communicating with the interior of the housing, the first port extending from the first member of the housing;

a diaphragm located in the housing, the diaphragm having a first side and a second side; and a switch for producing a signal indicating an increase in pressure on the first side of the diaphragm; and wherein the sensor pipe communicates increased pressure in the sensor pipe to the sensor-controller to activate the sensor-controller to open the valve independent of operation of the sump breather.

8. The vacuum sewage system according to claim 7, wherein the sensor pipe communicates increased pressure in the sensor pipe to the sump breather to activate the sump breather.

9. The vacuum sewage system according to claim 8, wherein the sensor-controller is activated at a lower pressure than is the sump breather during normal operation of the sensor-controller.

10. The vacuum sewage system according to claim 1, wherein the sensor pipe communicates increased pressure in the sensor pipe to the sensor-controller to activate the sensor-controller and to the sump breather to activate the sump breather.

11. A vacuum sewage system including a sump breather apparatus, the sump breather apparatus including:

a sensor pipe; and a sump breather, the sump breather including:

a housing having a first member and a second member;

a first port communicating with the interior of the housing, the first port extending from the first member of the housing;

a diaphragm located in the housing, the diaphragm having a first side and a second side;

a switch for producing a signal indicating an abnormal state of operation of the vacuum sewage system; and wherein the first port communicates with the interior of the housing on the first side of the diaphragm and wherein the sump breather further includes second, third, fourth, fifth and sixth ports extending from the second member of the housing, the second, third, fourth, fifth and sixth ports communicating with the interior of the housing on the second side of the diaphragm.

12. The vacuum sewage system according to claim 11, further including a spring and wherein the spring biases the diaphragm toward the first member of the housing.

13. The vacuum sewage system according to claim 12, wherein the diaphragm moves in response to pressure communicated to the interior of the housing toward the second member of the housing to seal the third, fourth, fifth and sixth ports.

14. The vacuum sewage system according to claim 13, further including a spring cup and wherein movement of the diaphragm toward the second member of the housing causes the spring cup to activate the switch.

15. The vacuum sewage system according to claim 14, further including a relief valve to prevent delayed operation of the sump breather.

* * * * *